XR 4,052,720 522 X 340/310R

United States
McGregor et al.
X 340/566 X 340/601
X 340/577 X 340/692
4,052,720
Oct. 4, 1977

[54] DYNAMIC SOUND CONTROLLER AND METHOD THEREFOR

[76] Inventors: Howard Norman McGregor, 6651 S. Wellington Court, Littleton, Colo. 80121; Robert Charles Chanaud, 1708 Hillside Road, Boulder, Colo. 80302

[21] Appl. No.: 667,449

[22] Filed: Mar. 16, 1976

[51] Int. Cl.[2] ..... G08B 29/00

[52] U.S. Cl. ..... 340/420; 179/1 P; 340/261

[58] Field of Search ..... 179/1 P, 1 AA; 340/261, 340/420

[56] References Cited

U.S. PATENT DOCUMENTS

| | | | |
|---|---|---|---|
| 3,205,316 | 9/1965 | Hechler | 179/1 AA |
| 3,304,368 | 2/1967 | Ford | 179/1 P |
| 3,410,958 | 1/1968 | Cohen | 179/1 P |
| 3,567,863 | 3/1971 | Morrissey | 179/1 AA |
| 3,833,897 | 9/1974 | Bell | 340/261 |
| 3,838,408 | 9/1974 | McMaster | 340/261 |

*Primary Examiner*—Harold I. Pitts
*Attorney, Agent, or Firm*—Burton & Dorr

[57] ABSTRACT

A dynamic sound controller is designed to automatically adjust and shape the spectral distribution and amplitude of random masking noise before delivery via speakers to the environment of a room according to a preprogrammed timing sequence. In addition, the sound controller is capable of operating as a security and fire alarm system and is further capable of mixing a predetermined amount of background music and paging signals into the same set of speakers. The sound controller of the present invention is further adaptable to a variety of environmental detectors which adjust and shape the noise in response to such factors as temperature, humidity, light level, ionization level and background noise level. A method for shaping spectral distribution and for adjusting amplitude of masking noise in relation to the measured ambient and intrusion noise levels is disclosed.

34 Claims, 10 Drawing Figures

DYNAMIC SOUND CONTROLLER AND METHOD THEREFOR

BACKGROUND OF THE INVENTION

1. Field of the Invention.

The present invention relates generally to sound control systems and more particularly to a random noise masking system being dynamically and adaptedly responsive to a variety of inputs.

2. Description of the Prior Art.

Sound control of rooms in buildings have been known in the prior art to embrace a variety of separate component systems usually resulting in large economic waste and duplicated effort. An early type of sound control is the common paging system which utilizes a plurality of disposed loudspeakers being tied to a common amplifier which responds to a voice input on a remote microphone. Paging systems over the years have become more sophisticated and may actually induce noise into the page in order to reinforce the paging signal. See e.g., the A.A.A. Tomatis U.S. Pat. No. 3,101,391 issued Aug. 20, 1963. In addition, systems have been designed to raise the volume of the paging signal in response to an increasing level of background noise. See e.g., E. S. Seeley, U.S. Pat. No. 3,133,990 issued on May 19, 1964 and V. J. Meyers, U.S. Pat. No. 3,160,707 issued on Dec. 8, 1964.

Another common type of sound control is a music background system in which music is provided from a recording or the like into an amplifier for driving a plurality of spatially disposed speakers. Such systems have been known in the art to increase workers' productivity and to raise the morale of the environment. It is not uncommon, therefore, to find music systems which play a variety of renditions of different psychological moods at various intervals of time. The programmed music can be self-contained in a tape loop, or it can be brought in from an outside cable or antenna. Studies have shown that in general workers have a performance peak in the morning, and a reduction in performance after lunch, regardless of whether the lunch is eaten or not. Other studies have shown that the addition of background music can increase performance by modification of the program material, in particular, having the program more lively as time passes.

Another example of a prior art sound control system is a noise mask or speech privacy system. The purpose of a noise masking system is to provide a noise background that has a proper distribution of frequencies and amplitudes to effectively reduce interference associated with overheard speech, particularly in open spaces. With the development of large open spaces in buildings, which provide a great degree of space planning options, the speech interference of one worker with another creates a noise problem, as well as a loss of confidentiality. Such interference has been termed an "intrusion noise" that is the additional noise level above the normal room noise or "ambient level." Noise masking systems were developed to alleviate these difficulties by providing a series of loudspeakers in the ceiling plenum which are fed sequentially by a noise generator, a noise spectrum shaper and a power amplifier. The value of noise masking is so well recognized that one prior art approach discloses a portable noise generator for use in a variety of rooms and adverse ambient noise conditions. See e.g., T. G. Morrissey, U.S. Pat. No. 3,567,863 issued on Mar. 2, 1971. See also W. T. Cavanaugh, et al, "Speech Privacy in Buildings," 34 J. Acous. Soc. Amer. 475 (1962).

In the case of music and noise masking systems, the range of sound levels experienced by the workers must be never so low at any instant as to allow long range speech communication and never so high as to disrupt the workers' activity. More fundamentally, at the end of each day prior art paging, music or noise masking systems are not shut down.

Another type of sound control system is a security system in which a plurality of microphones are spatially disposed in the room or building and are interconnected into am amplifier for driving a detector circuit which, in the presence of an invasion noise, activates an alarm system. Such systems are generally only activated after working hours as a security measure.

The performance of a worker, however, depends on many more factors other than just the acoustical environment. Some of these factors, although very important, are not under the control of the building designer or operator and are not discussed here. The designer or operator, however, can control such environmental factors as sound, ionization level, light level, humidity and temperature. Studies have been conducted, and design rules and regulations are available which include these factors. Once these environmental factors are determined, they are implemented through building design, and generally they remain constant thereafter except for gross changes. For example, lighting levels in an office are constant until the lights are turned off in the evening. Some accommodations to changing conditions during work day have been made. For example, air conditioning systems can be designed so that as the temperature outside of a building goes up near mid-day, the inside temperature increases so that a differential remains constant. Such an accommodation reduces the thermal shock so often noticed when entering a cool building from an extremely warm outside. The improvements in building design can accommodate such changes in human comfort or attitudes during the work day, but most have not been made. The effect of background sound either through injecting masking noise or music into the room based on such factors is only beginning to become understood. Clearly background music or noise affects a person's attitude towards temperature, humidity, light level, ionization level and background noise level. However, no noise masking or music systems are adaptable to such environmental factors.

The major disadvantage of the above prior art sound control approaches is simply that economic waste is apparent through the duplication of amplifiers, loud speakers and other similar equipment. In addition, the prior art approaches are not variable either in spectral distribution or in amplitude with time throughout the day, but rather are constant throughout their application and certainly are not adaptable either to environmental factors or to the background noise of the building. For example, it is wellknown that in certain rooms disposed above nightclubs and bars, that throughout the better part of the day, the background noises substantially are at a minimum level. In the time interval from 9:00 P.M. to 2:00 A.M., however, substantial background noise may be apparent and may transmit upwardly and into the room. No prior art noise masking systems are preprogrammed to take into account this varying intrusion noise.

The present invention overcomes the above disadvantages by providing a completely random noise source for generating a plurality of different masking noises; by providing means for temporally and spatially varying the spectral distribution and adjusting the amplitude of the sound output in a plurality of speakers; by mixing paging commands, music and masking noise together in an aesthetically pleasing environment; by responding to various environmental factors with a predetermined mixture of masking noise and music; by making the transition between the various different temporal states slowly so as not to be consciously detected by persons in the room; by incorporating a security system into the noise and music system, and for manufacturing a low cost noise masking and music system.

OBJECTS OF THE INVENTION

It is an object of this invention to provide a sound control system for shaping and conditioning the delivery of masking noise into a room or building environment.

It is another object of this invention to provide a sound control system which produces random masking noise, which generates a plurality of cyclic predetermined timed intervals, which modifies the noise according to a preprogrammed state existing in each of the plurality of cyclic predetermined timed intervals for conditioning the noise, and in which is provided loudspeakers receptive of the modified noise for injecting the noise into the room.

It is another object of the present invention to provide an adaptive noise masking system for injecting noise into a room which contains a plurality of environmental detectors each of which is responsive to an environmental factor for generating a unique output representative of that factor, a random masking noise generator, and a controller operative with the environmental detectors for automatically adjusting the amplitude and shaping the spectrum of the noise from the generator.

It is a further object of the present invention to provide a combined noise masking and security system of low cost and ease in installation.

It is a further object of this invention to provide a combined noise masking and security system which contains a noise generator, a timer for providing first and second timed intervals, a plurality of speakers which are also selectively capable of detecting sound, and a control for extending noise from the generator to the speakers during the first timed interval and for signalling the presence of any sound pickup in the speakers during the second timed interval.

It is a further object of the present invention to provide a dynamic combined noise masking and music system which contains a noise generator, a music sound, a timer for generating a plurality of cyclic predetermined time intervals, a controller for spectrally shaping and changing the amplitude of a mixture of the noise and music into a plurality of predetermined different states each occurring during its respective cyclic time interval, and a plurality of loudspeakers receptive of the shaped mixed noise and music for injecting the mixture into the room.

It is a further object of the present invention to provide an adaptive noise making and combined music system which contains a plurality of environmental detectors, a noise generator, a music source, a timer for generating a plurality of cyclic predetermined timed intervals, a controller for modifying a noise and music mixture into a unique state which occurs during the cyclic reappearance of its uniquely assigned timed interval, and a plurality of loudspeakers receptive of the mixed noise and music for injecting the mixture into the room.

It is another object of this invention to provide a sound control system for fire detection in which prerecorded information is made available to a preselected number of rooms in a preprogrammed manner.

Other objects, advantages and capabilities of the present invention will become more apparent as the description proceeds taken in conjunction with the accompanying drawings.

SUMMARY OF THE INVENTION

The present invention comprises a sound control system designed for placement in a building for controlling sound disposed therein. In one mode of operation, the sound controlling system of the present system generates noise from a random noise generator, spectrally shapes the frequency distribution of the noise and delivers the shaped noise through an amplitude control for delivery through a plurality of loudspeakers into a room. Both the spectral shaping and the amplitude adjusting are manipulated by a controller which causes the spectral shape and the amplitude of the random noise to very at periodic intervals in a predetermined manner. Such variations of the spectral shape and amplitude of the noise is necessary to fully adapt the masking noise to the varying conditions of the ambient noise within the room and the varying conditions of any intrusion noise thereinto.

In another mode of operation, the sound control system of the present invention automatically and dynamically injects music into the masking noise in order to psychologically tailor the environment of the room to any persons disposed therein. In this manner, the amplitude of the music is also controlled by a controller to vary the amplitude at a predetermined rate throughout the course of a day.

In yet another mode of operation, the sound control system of the present invention injects a paging signal that overrides both the injected music and the shaped masking noise.

In yet another mode of operation, the sound control system of the present invention finds application as a security system in that during a given time interval, usually the night time period, the speakers are disconnected from the noise, music and paging generators in order to act as the noise, music and paging generators in order to act as microphones for delivery of any invasion noise above the ambient level into an alarm detector circuit.

In yet another mode of operation, the sound controller of the present invention receives a variety of environmental inputs in order to further tailor the shaped masking noise and the injected music before delivery into the room.

In yet another mode of operation, the sound controller of the present invention responds to a fire detector to inject into the room prerecorded messages.

A method of the present invention includes the determination of the ambient noise within a room throughout a twenty-four hour period, the extent of any intrusion noise into the room due from external sources which occurs during the twenty-four hour period, and preprogramming the sound control system of the present invention to automatically and periodically inject random masking noise and music into the room in a manner that optimizes the psychological effect of the mixture onto a person residing in the room.

GENERAL DESCRIPTION OF THE PREFERRED EMBODIMENT

Figure 1:
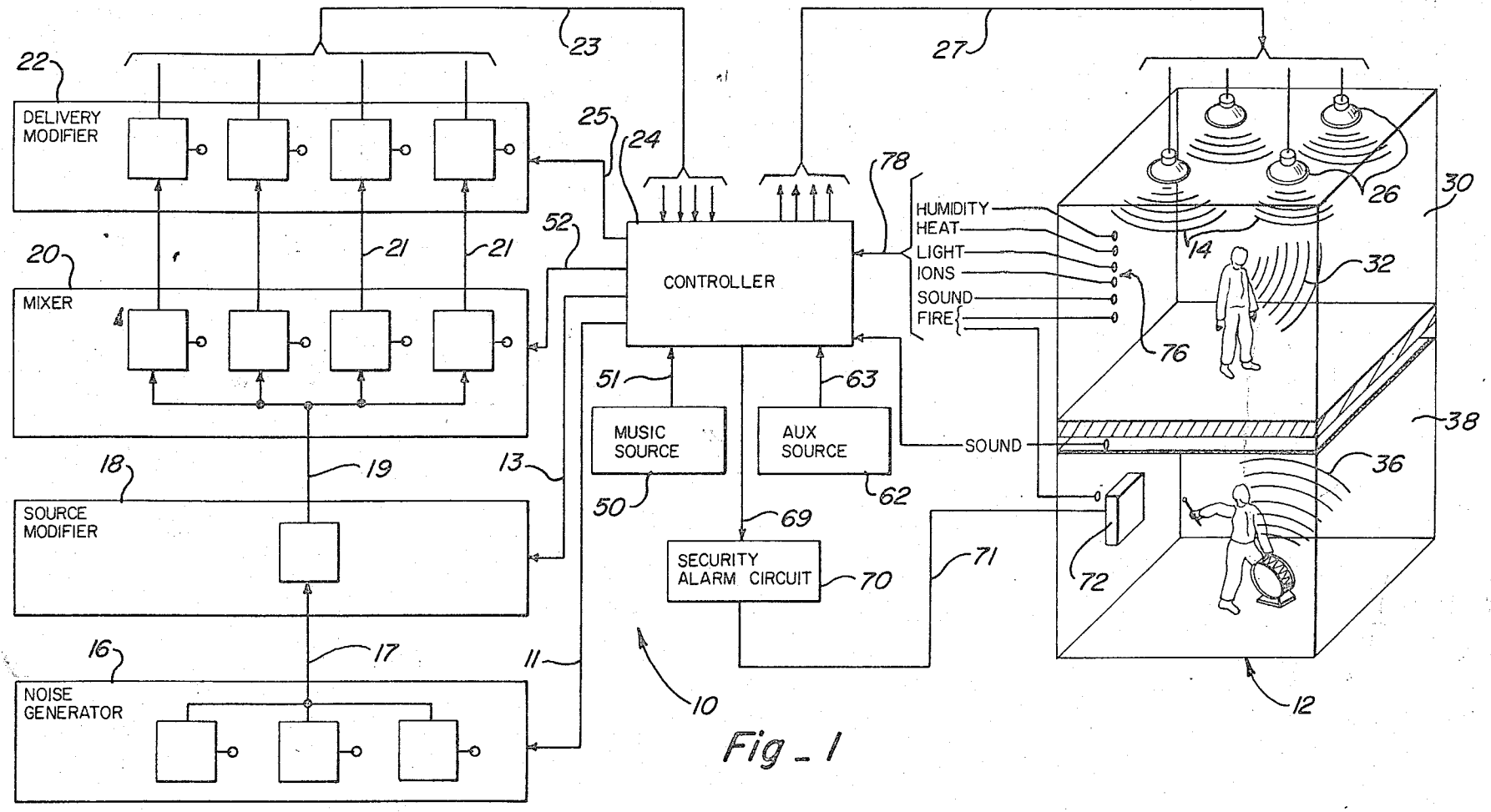
FIG. 1 is a block diagram of the sound control system of the present invention which responds to a variety of preprogrammed and environmental inputs and which performs as a security system.

The dynamic sound control system 10 is designed for placement in a room or building 12 for controlling the sound 14 disposed therein.

In one mode of operation the sound controlling system 10 of the present invention generates noise from a noise generator 16, spectrally shapes the frequency distribution of the noise in a source modifier 18, delivers the "colored" or shaped noise through a mixer 20 and into a delivery modifier 22 which changes the amplitude of the noise. The masking noise is then delivered through a controller 24 for delivery into a plurality of speakers 26. In this mode, the controller 24 delivers masking noise 14 into room 30 based on a predetermined program of amplitude and spectral distribution of the noise.

Figure 2:
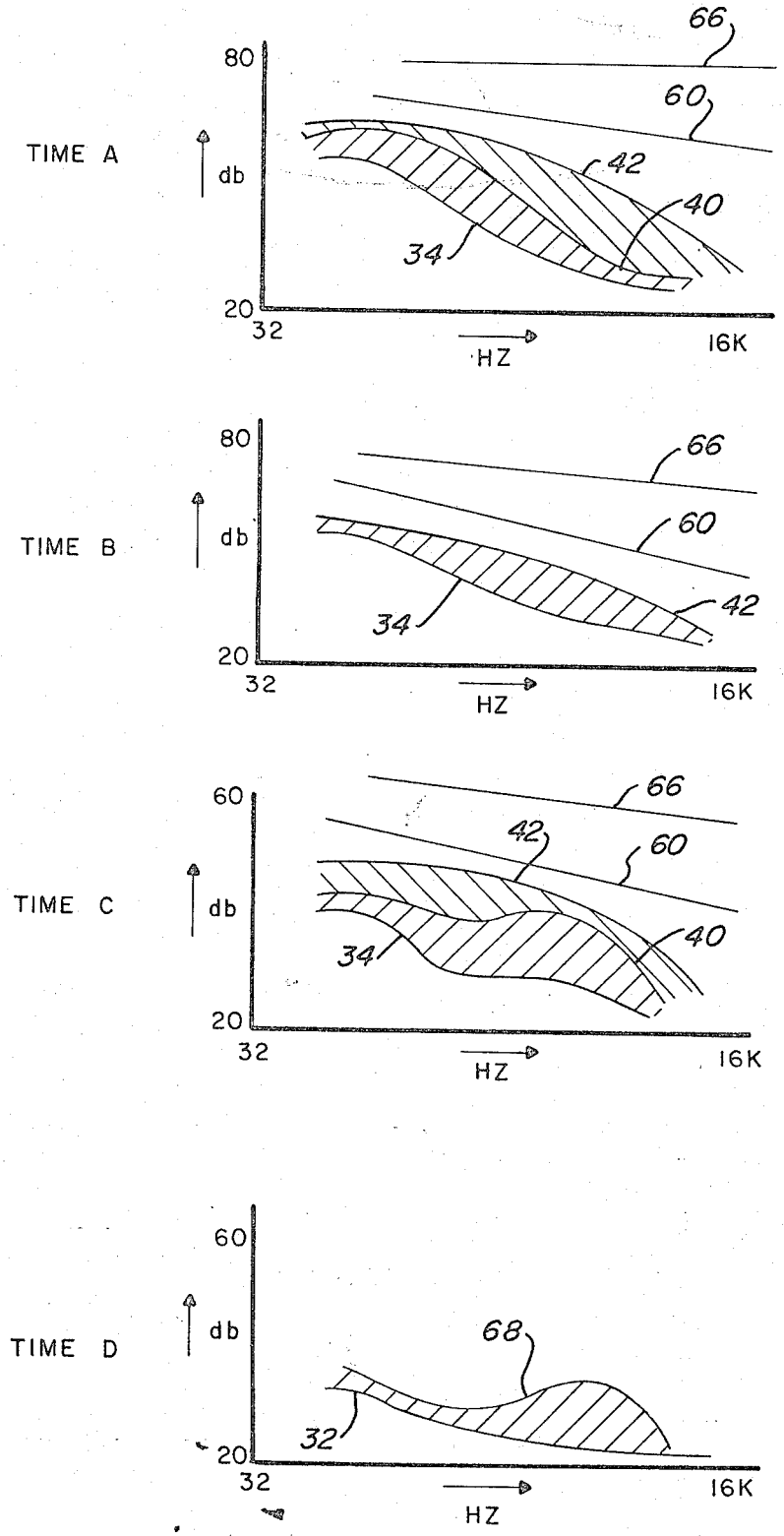
FIG. 2 is a series of graphs illustrating the distribution of a variety of sound inputs in a room during different time intervals of the day.

In FIG. 2 is shown a series of four graphs representing various time intervals during a day. These graphs represent the sound in room 30 during a twenty-four hour period based on a typical day. During time interval A an ambient background noise level 32 exists in the room due to normal activity therein which is represented by curve 34. It is to be noted that curve 34 varies throughout the four time periods A through D during the course of the day both in spectral distribution and in amplitude of sound level. This ambient noise is readily determined through use of a sound level meter. Ambient noise is thus defined as that noise normally occurring within room 30.

Also apparent in room 30 may be an intrusion noise 36 emanating from a source outside of room 30, e.g. room 38. This intrusion noise 36 is represented as curve 40 in FIG. 2. Note that the intrusion noise 40 occurs at intervals throughout the course of the day. Such intrusion noise may arise, for example, in a restaurant that serves lunch and that later on in the evening becomes a nightclub. Therefore, in time interval A noise may be generated due to luncheon patrons visiting room 38, while during time interval B which corresponds with the afternoon period no noise is generated, but during time interval C which corresponds to the late evening hours, considerable high frequency noise may be generated by a musical band or the like. Finally, in time interval D corresponding to the early morning hour period, intrusion sound 36 and ambient sound 32 are minimal. This intrusion noise can also be readily determined both as to spectral and amplitude content at the various intervals during the day with a sound level meter. Intrusion noise is thus defined as that noise which enters room 30 from a source outside of room 30.

Under well-known noise masking techniques, masking noise 14 can be injected into the room 30 as is represented by curve 42 in FIG. 2. One characteristic of the masking noise curve 42 is its generally downwardly arcuate shape exhibiting gentle slopes. Such slopes are known in the art to be most agreeable to persons within room 30 with a minimum conscious recognition thereof. The masking noise curve 42 shown in FIG. 2 is of sufficient amplitude and spectral shape to override any peaks of intensity of the intruding noise 40 as shown in time intervals A, B and C. The production of a masking noise 14 as represented by curve 42 sufficiently ameliorates the effect of the intrusion noise 36 as represented by curve 40. Masking noise is thus defined as that noise of sufficient spectral shape and amplitude that results in a minimum of amplitude but which effectively covers or masks ambient or intrusion noise. It is to be noted that during time interval A, the intrusion noise has high amplitude low frequency sounds. The masking noise must be tailored to that intrusion noise to effectively cover the high amplitude low frequency sounds and to gradually decline to low amplitude levels at the high frequency end. Likewise, in time interval C where the intrusion noise has high amplitude high frequency sounds, the masking noise must be suitably tailored or shaped.

The noise generator 16, the source modifier 18 and the delivery modifier 22 under control of the controller 24 automatically change the spectral density and amplitude of the masking noise 14 in a manner to be more fully discussed in order that curves 42 effectively ameliorate the intrusion noise 36 as represented by curve 40. It is apparent that controller 24, therefore, must continuously and periodically change the amplitude and spectral shape of the noise 14.

In another mode of operation the sound control system 10 of the present invention operates as a music system in that music is provided from a music source 50 for delivery into the controller 24 over path 51 and subsequently over path 52 for delivery into the mixer 20. The music is then delivered over paths 21 into delivery modifier 22 for subsequent delivery into the loudspeakers 26. The music is an element of the sound 14 emanating from the loudspeakers 26 and is represented in FIG. 2 by curve 60. It is important to note that the music amplitude 60 is greater than the level of the masking noise 42 so that persons within room 30 are conscious of the music. During time interval A, the controller adjusts the level of the amplitude of the music over lead 25 to a higher than the level of the music in time intervals B and C. This is to accommodate the psychology of the environment, including persons disposed therein. During the morning hours just before noon, a higher level of music is generally desired in order to increase productivity and alertness of persons situated in room 30. In time interval B which corresponds to the afternoon hours, the music subsides to a lower level as represented by curve 60, however, during the late evening hours, should the workers desire, the music may be obtained at a higher level 60 thereby effectively diverting the attention of the worker from the masking noise and the intrusion noise.

In yet another mode of operation, the sound control system 10 of the present invention finds the application as a paging system in which a paging input 62 is provided to the controller 24 over lead 63. The paging signals are provided to the delivery modifier 22 over leads 25 for subsequent delivery into the loudspeakers 26. Once again the paging signal forms an element of the sound 14 and is shown in FIG. 2 as curve 66. It is to be readily noted that the curve 66 is significantly louder than either the music or any other signal shown in FIG. 2. This is necessary since when a paging command is issued, the attention of any workers in room 30 must be immediately diverted to the paging signal.

In yet another mode of operation, the sound control system 10 of the present invention finds application as a security system in that during time interval D as represented in FIG. 2 when only an ambient level of sound 32 as represented by curve 34 is present within the room any invasion noise as represented by curve 68 is detected by the loudspeakers 26 and is amplified by the security alarm circuit 70, which in turn activates an alarm 72 over lead 71. Such invasion noise 68 may occur when, for example, a burgular enters room 30 and generates the additional noise as represented by curve 68 of FIG. 2.

In yet another mode of operation, the controller 24 receives a variety of inputs 76 over leads 78 which are representative of a plurality of environmental factors such as humidity, heat, light, ionization, and background sound. The controller 24 in a manner to be more fully described reacts to these various environmental detectors 76 in order to more precisely shape the masking noise before delivery into room 30 as previously discussed.

In yet another mode of operation, the controller 24 responds to a detection of fire either in room 30 or room 38 to extend from the auxiliary source 62 into the speakers 26 prerecorded messages informing the occupants of fire and instructing the occupants of appropriate exit passages.

DESCRIPTION OF THE DETAILED EMBODIMENT

Figures 3, 4:
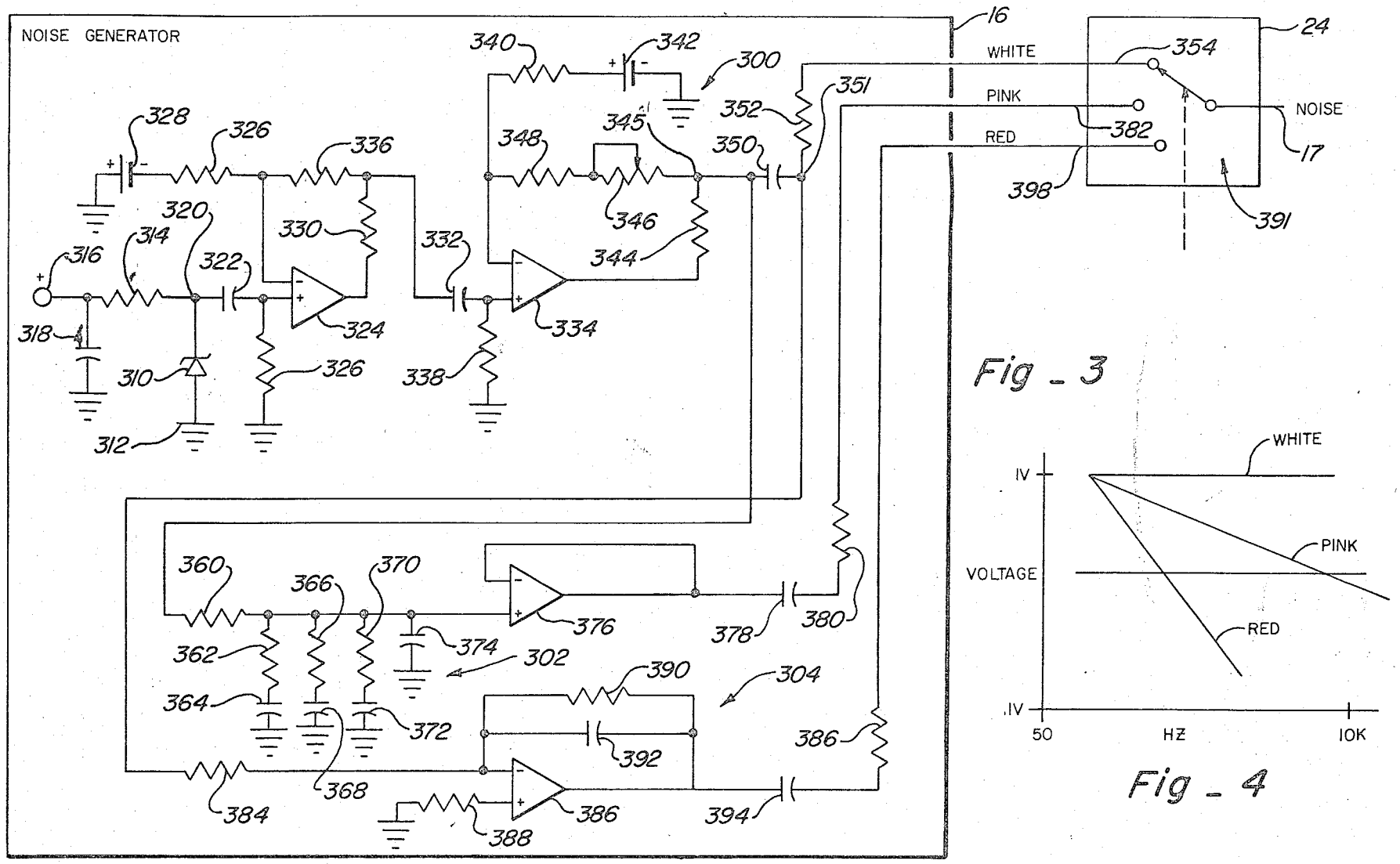
FIG. 3 is an electronic circuit of the present invention for generating a plurality of different random masking noises.
FIG. 4 illustrates the noise output curves of the noise generator as shown in FIG. 3.

The noise generator 16 is shown in a preferred embodiment in FIG. 3. It is to be expressly understood, however, that any of a number of conventional noise generators may be utilized in the sound control system 10 of the present invention including those manufactured, for example, by General Radio Corporation of Concord, Massachusetts as Model Nos. 1381 and 1382 as disclosed in "General Radio Catalog 73."

The noise generator 16, however, of the preferred embodiment includes a circuit 300 for generating white noise, a circuit 302 for generating pink noise and a circuit 304 for generating red noise. The frequency distribution in relation to amplitude is shown in FIG. 4 for each of these noise configurations. It is to be noted that white noise is more psychologically stimulating due to the higher frequencies having higher amplitudes than red noise which tends to be less evenly distributed and more psychologically relaxing.

The white noise is generated from a noisy diode 310 preferably of the type manufactured by Micrometics as Model No. SD10W115. Any conventional noisy diode, however, will find application. The diode is grounded at one end 312 and is biased through a resistor 314 to a voltage source 316 which is also connected in parallel with a capacitor 318 to ground. The node 320 between resistor 314 and diode 310 is delivered through a capacitor 322 to the plus input of an operational amplifier 324. The plug input of amplifier 324 is also grounded through resistor 326. The minus input of the operational amplifier 324 is connected in series to a resistor 326 and through to a voltage source 328 which is then grounded. The output of the operational amplifier 324 is delivered through resistor 330 into a series connected capacitor 332 and into the plus input of the operational amplifier 334. The output of the operationl amplifier 324 is also delivered through resistor 330 through resistor 336 and into the minus input of the operational amplifier 324. The plus input to the operational amplifier 334 is further grounded through resistor 338. The minus input of operational amplifier 334 is connected in series with a resistor 340 to a voltage source 342. The output of the operational amplifier 334 is delivered through resistor 344 back through potentiometer 346 and resistor 348 into the minus input of amplifier 334. The signal output between resistor 344 and potentiometer 346 is further delivered to a capacitor 350 and a series connected resistor 352 to the white noise output 354.

The signal appearing at node 345 is further delivered into resistor 360 of the pink noise circuit 302 and is shunted to ground through a plurality of frequency shunts which include the following connections to ground: resistor 362 and capacitor 364, resistor 366 and capacitor 368, resistor 370 and capacitor 372, and through capacitor 374. The output of resistor 360 is further delivered to the plus input of operational amplifier 376 whose output is delivered back into the minus input of the amplifier 376 and also through the series connection of capacitor 378 and resistor 380 to the output 382.

The signal from node 351 of the white noise circuit 300 is further delivered into a resistor 384 of the red noise circuit 304 for delivery into the minus input of the operational amplifier 386. The plus input of amplifier 386 is grounded through a resistor 388. The output of the amplifier 386 is delivered back into the minus input through a parallel combination of resistor 380 and capacitor 392. The output of the amplifier 386 is further delivered through the series combination of capacitor 394 and resistor 396 to the red noise output 398.

The noise generator 16 of the preferred embodiment uses the following typical values: Resistors:

314 = 160 Kohm

326 = 1 Mohm

330 = 47 ohm

326 = 47 ohm

338 = 1 Mohm

345 = 47 ohm

348 = 1 Kohm

340 = 47 ohm

352 = 500 ohm

360 = 7 Kohm

362 = 3.09 Kohm

366 = 953 ohm

370 = 309 ohm

380 = 500 ohm

384 = 20 Kohm

388 = 20 Kohm

390 = 100 Kohm

396 = 500 ohm

Capacitors:

318 = 25 uf

322 = 0.1 uf

332 = 0.1 uf

350 = 0.1 uf

364 = 1 uf

368 = 0.287 uf

372 = 0.0866 uf

374 = 0.0442 uf

378 = 0.1 uf

392 = 0.1 uf

394 = 0.1 uf

Potentiometers

336 = 4.7 Kohm

346 = 50 Kohm

In FIG. 4 is shown a graphic representation of the outputs of the noise generator 16 of the present invention. It is to be noted that voltage appears on the ordinate scale and frequency on the abscissa scale. White noise is substantially uniform in amplitude throughout the frequency range, while pink and red noise display greater degrees of slope due to the lower amplitude for the higher frequency ranges.

The operation of the noise generator in FIG. 3 will now be discussed. Random noise is generated by the noisy diode 310 and is amplified by a high gain audio amplifier 324. The output of the amplifier 324 is further amplified by a second high gain amplifier 334 whose gain is set by adjustment of the potentiometer 346. The output of the second high gain amplifier 334 is delivered through a capacitor 350 to block any DC offset and is further delivered through resistor 352 which functions as a current limiter to protect the circuit from any shorts on the output 354. The noise from the noisy diode 310 is random and is flat as shown in FIG. 4 and is delivered on lead 354. The white noise signal from node 345 is delivered into a complex high frequency network in order to drop the amplitude of the high frequency end as shown in the pink curve of FIG. 4. This curve undergoes a minus 3dB per octave slope. This shaped signal is then delivered into a buffer amplifier 376 for delivery through the blocking condenser 378 in the limiting resistor 380. The white noise signal at node 351 is delivered into an integrator operational amplifier 386 where the signal is integrated to produce the minus 6dB per octave slope of the red curve as shown in FIG. 4. Once again, the red noise is delivered into a blocking capacitor 394 and a current limiting resistor 396.

A portion of the controller 24 is also shown in FIG. 3 to include a manual switch capable of interconnecting the noise output 393 to either the white noise 354, the pink noise 382 or the red noise 398. As will be explained in a later discussion, this can be automatically selected in a preprogrammed sequence.

Figures 5, 6:
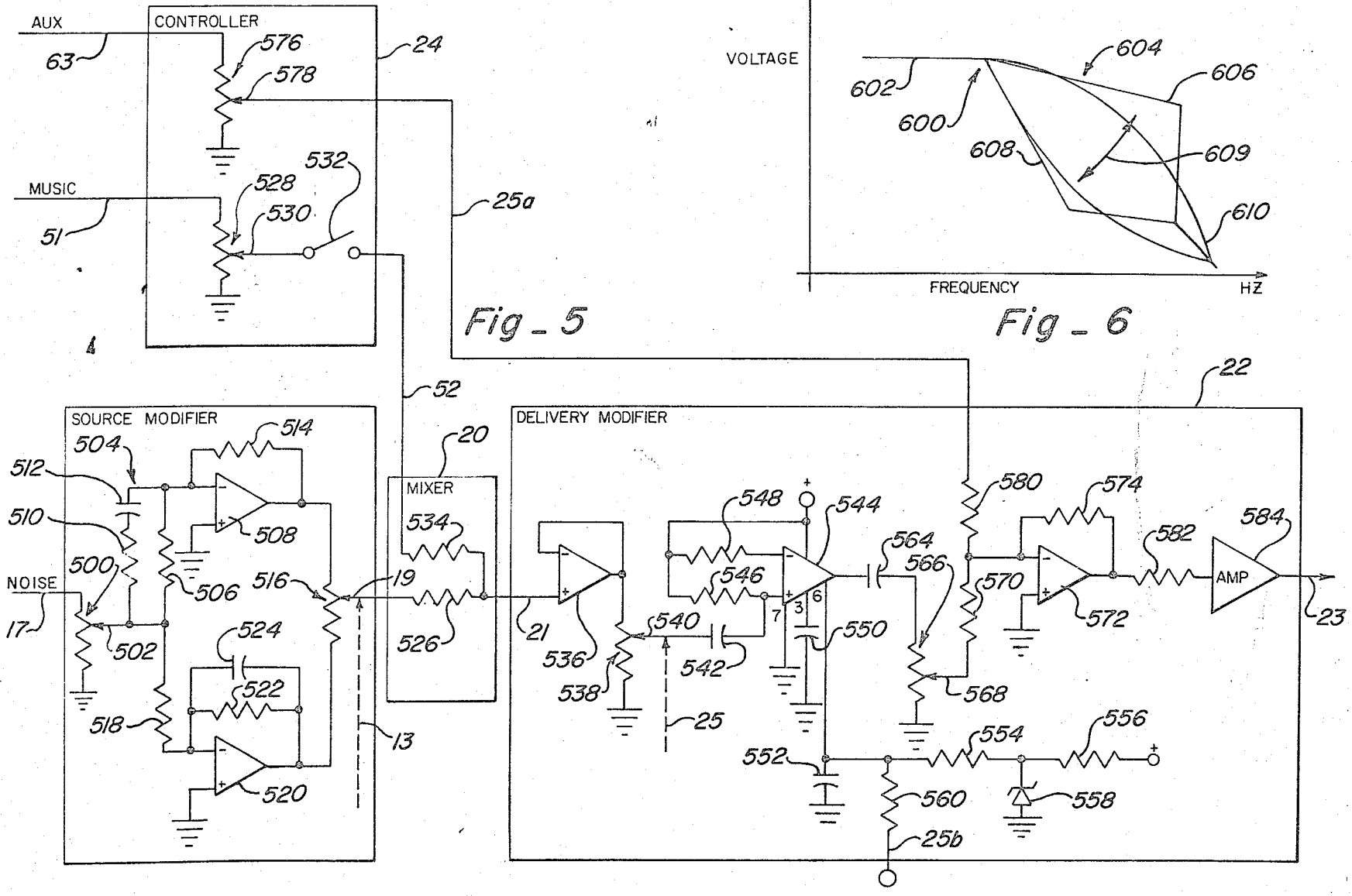
FIG. 5 is an electronic circuit for the source modifier, mixer, and delivery modifier of the present invention.
FIG. 6 is a graphical representation of the output curves of the source modifier of FIG. 5.

The source modifier 18 is shown in detail in FIG. 5 to include a potentiometer 500 connecting in series to the noise signal 17 and ground having a variable tap 502 for providing a manual control of the amplitude of the noise signal being inputed into the source modifier 18. Tap 502 is provided to a coloring circuit 504 and is further connected in series to a resistor 506 which inputs the minus input of an operational amplifier 508 whose plus input is grounded. The tap 502 is also connected in parallel to the plus input of amplifier 508 through a resistor 510 and a capacitor 512. The output of the amplifier 508 is connected back through a resistor 514 also to the minus input of the amplifier 508. The output of the amplifier 508 is further connected to one end of a potentiometer 516. The tap 502 is further connected through a resistor 518 to the minus input of an amplifier 520, the plus input of which is grounded. The output of the amplifier 520 is fed back through a parallel combination of a resistor 522 and a capacitor 524 into the minus input of the amplifier 520. The output of the amplifier 520 is further connected to the opposing end of the potentiometer 516. The tap 19 of the potentiometer 516 is moveable under action of the controller as represented by dotted line 13.

The following component parts are utilized in the source modifier 18:

Resistors:

506 = 100 Kohm

510 = 100 Kohm

514 = 100 Kohm

518 = 100 Kohm

522 = 100 Kohm

Capacitors:

512 = 0.016 uf

524 = 0.016 uf

The output of tap 19 is shown in FIG. 6 for the pink noise signal at input 17. The output curve 600 includes a first region 602 at the lower frequency which is of reduced amplitude in order to prevent overdriving of the loudspeakers 26. The mid-range region 604 is comprised of a variety of different possible slope conditions dependent upon the position of the tap 19 in relation to the potentiometer 516. Through mechanical movement of tap 19 by the controller as will be hereinafter disclosed, the output shape may range between one of two extremes. The upper extreme 606 emulates or resembles the white noise curve of FIG. 4 and the range 608 emulates or resembles the red noise curve of FIG. 4. The upper range of frequency 610 is also dampened in order to prevent harm or overdriving to the speakers 26 and also to prevent any sharp noises from interfering with the aesthetics of the masking noise.

The output of the source modifier 18 is delivered over lead 19 into mixer 20. The noise signal appearing on lead 19 enters a series resistor 526. At this time, a music signal 51 appearing from the music source 50 is delivered into controller 24 and forms a series connection with potentiometer 528, the other end of which is grounded. A tap 530 from the potentiometer 528 delivers the music signal into a switch 532. The switch 532 is manually activated at the controller panel 24. The output signal is delivered over lead 52 into the mixer 20 through a series connected resistor 534. The two resistors 526 and 534 are interconnected and form the output 21.

The component parts in the mixer 20 comprise the following:

Resistor 526 = 10 Kohm

Resistor 534 = 10 Kohm

The output 21 from the mixer 20 is interconnectd with the delivery modifier 22 and enters the plus input of an amplifier 536, the output of which is interconnected back into the minus input of the amplifier 536. The amplifier 536 is further interconnected in series with a potentiometer 538 which is interconnected to ground at the opposing end. A tap 540 is varied mechanically by a mechanical interlink to the controller over link 25. Tap 540 is delivered into a capacitor 542 which is interconnected to the plus input of an amplifier 544. The plus input is further connected through a resistor 546 to a positive voltage supply. Resistor 548 is also interconnected to the positive voltage supply and into the minus input of the amplifier 544. The amplifier 544 is a variable gain amplifier of the type manufactured by National Semiconductor as LM304. Pin 7 of the amplifier 544 is grounded. Pin 3 is grounded through a capacitor 550. Pin 6 is grounded through a capacitor 552 and is further interconnected in series to a resistor 554 and a resistor 556 to a positive voltage supply. The node between resistors 554 and 556 is grounded through a zener diode 558. An input 256 is provided to pin 6 through reistor 560. As will be discussed, the voltage at pin 6 determines the gain of the amplifier 544. The output of the amplifier 544 is interconnected in series to a capacitor 564 and a potentiometer 566 to ground. The tap 568 of the potentiometer 566 is delivered through a resistor 570 and into the minus input of an amplifier 572. The plus input of the amplifier 572 is grounded. The output of the amplifier 572 is fed back through a resistor 574 into the minus input thereof.

At this point it is important to note that a signal from an auxiliary source 62 which may, for example, be from paging devices or prerecorded emergency messages is delivered over lead 63 into the controller 24 to access a potentiometer 576. A tap 578 extends the paging or auxiliary signal over lead **25*a* into the delivery modifier 22 and into a resistor 580 which is interconnected into the minus input of the amplifier 572. In this manner, a paging signal can be manually adjusted as to volume at the controller 24, and the signal is delivered into the sound conditioning system 10 of the present invention. The output of the operational amplifier 572 is further delivered into a resistor 582 for delivery into an amplifier 584. Amplifier 584 is conventional and may comprise any of a number of conventional sound amplifiers. The output of the amplifier is delivered over leads 23** and into the controller as will be subsequently discussed.

The components that comprise the controller 24 as shown in FIG. 5 are as follows:

Potentiometer 528 = 50 Kohm

Potentiometer 576 = 50 Kohm

The components which comprise the delivery modifier 22 of the present invention include:

Resistors:

546 = 2 Kohm

548 = 2 Kohm

554 = 2 Megom

556 = 4.7 Kohm

560 = 2 Megom

570 = 10 Kohm

574 = 68 Kohm

580 = 10 Kohm

582 = 50 Kohm

Capacitors:

542 = 10 uf

550 = 500 uf

552 = 100 uf

564 = 10 uf

Potentiometers:

566 = 50 Kohm

The operation of the source modifier, mixer, and delivery modifier of FIG. 5 will now be discussed. One of three possible noise sources (i.e. white, pink, or red) is selected by the controller 24 for delivery into the source modifier on lead 17. The signal enters a trim potentiometer 500 and then enters two parallel operational amplifier circuits in which one half comprises the amplifier 508 for cutting off low frequencies and the second half comprises amplifier 520 for cutting off high frequencies. If the potentiometer 516 has the center tap set in the mid-range position, then essentially any noise coming into the source modifier is delivered to the output without being substantially changed. The variation between the two extremities of the potentiometer 516, however, effectuate the change in the output noise curve as shown in FIG. 6 by the arrow 609. It is to be noted that the potentiometer center tap position is under control from the controller 24 by mechanical link 13. Thereby by automatically varying the potentiometer 516 setting, the output appearing on lead 19 is variable between a predetermined range. It is apparent that in FIG. 6 the upper range 606 more closely resembles white noise while the lower range 608 more closely resembles red noise. This "colored" or "shaped" signal is then delivered over lead 19 into a conventional resistive summing circuit where it is mixed with a music signal appearing over lead 52. The output of the mixer which is a combination of the music and spectrally shaped random noise is delivered into the delivery modifier over lead 21. In the delivery modifier 22, the combined music and shaped spectral noise is delivered into an operational amplifier 536 used as a source follower to prevent loading of the summing circuit. The output of the amplifier 536 enters potentiometer 538 which is mechanically controlled in a preprogrammed sequence by the mechanical link 25 from the controller 24. The potentiometer 538 changes automatically the amplitude of the combined music and shaped random noise. This amplitude controlled combined signal is delivered into a controlled gain amplifier 544. The gain of the amplifier 544 is controlled by the voltage which appears at input 6 of the amplifier 544. Dependent, therefore, on the voltage appearing on input 6 of the amplifier 544, the gain of the signal appearing at the output of the amplifier varies and is delivered into an offset or blocking capacitor 564 for delivery into a trimming potentiometer 566. The output of the trimming potentiometer 566 is ORed with the auxiliary signal through a resistive summing network 570 and 580. The balance between the amplitude of the auxiliary signal and the combined music and shaped random noise is controlled by potentiometer 566. The combined music, auxiliary, and shaped random noise signal is now delivered into an operational amplifier whose output is delivered through a current limiting resistor 582 for subsequent delivery into a conventional amplifier.

It is to be understood that the source modifier 18 is of preferable design and that other conventional frequency shapers may be utilized by the present invention without departing from the spirit and scope thereof. One such conventional approach is General Radio's Multifilter Model No. 1925 as discussed in the previously described catalog. In addition, any type of conventional summing circuit can be used by one skilled in the art other than the resistive network preferably used in FIG. 5. Other such networks include but are not limited to digital attenuators, analog summing circuits, and digital summing circuits.

It is highly desirable that when the background music and random noise appearing in the room 30 is turned OFF that the transition from the playing or ON state to the non-playing or OFF state occurs over a period of several minutes. This is necessary, once again, not to startle or arouse the perception of people situated in the room. In the delivery modifier 22 of the present invention is provided a slow turn-ON and turn-OFF circuit essentially comprising resistor 560 and capacitor 552. When lead 25*b* is placed at ground, the voltage at input 6 of amplifier 544 will eventually become ground when the resistor 560 and capacitor 552 discharge. The RC time constant of this discharge circuit, however, is several minutes. In this manner, the system may be gradually turned-ON or gradually turned-OFF.

Figure 7:
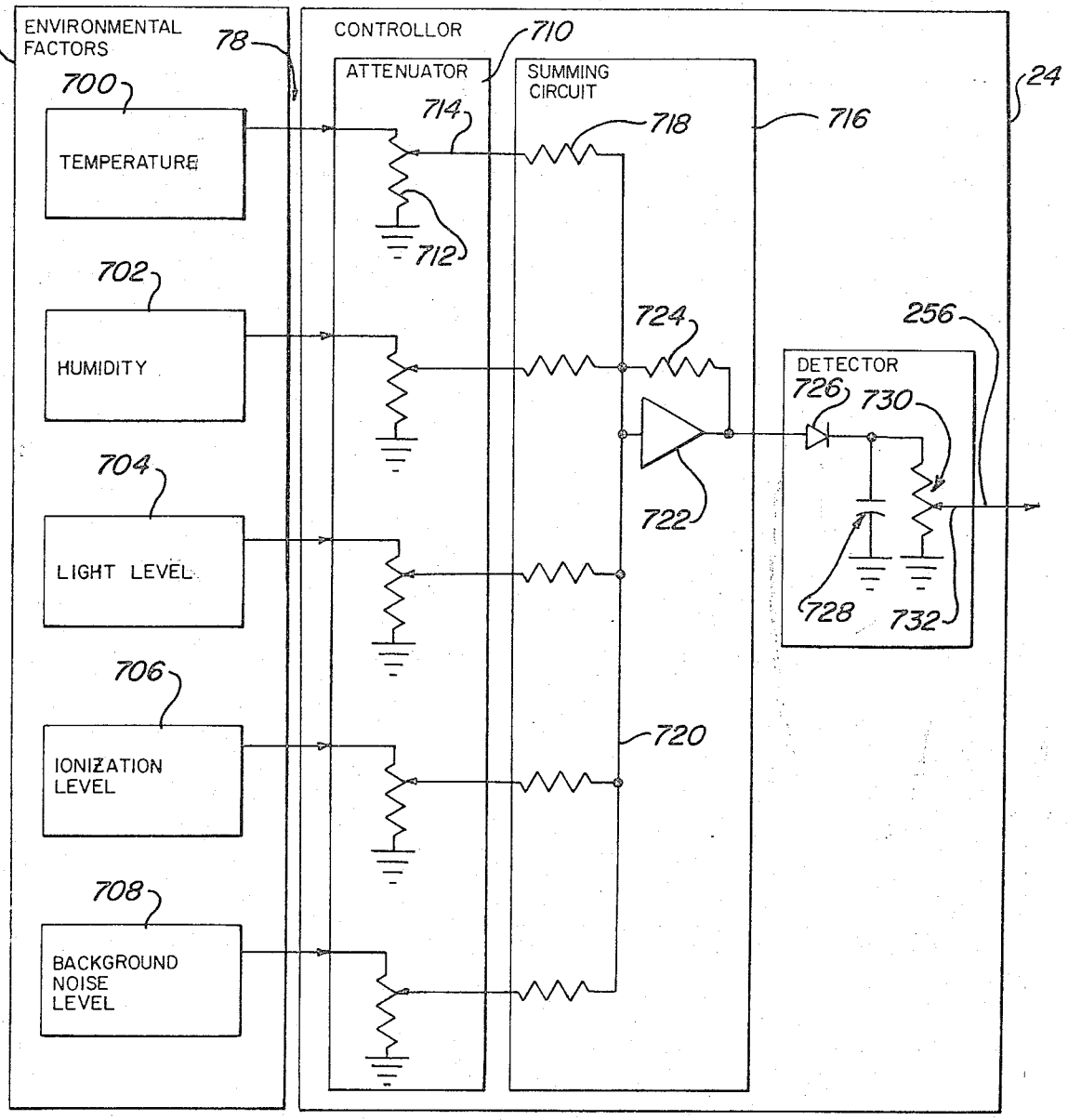
FIG. 7 is an electronic schematic of the environmental adaptive feedback circuit of the present invention.

In FIG. 7 is shown the adaptive circuitry of the sound control system 10 of the present invention. A plurality of conventional environmental detectors 76 are provided for sensing temperature 700, humidity 702, light level 704, ionization level 706 and background noise level 708. The output of these respective detectors 76 are collectively delivered over a cable conveniently termed 78 for delivery into the controller 24. The signals 78 collectively enter a corresponding set of attenuator devices 710. Each attenuator device in the present embodiment is preferably a grounded potentiometer 712 having a pickoff tap 714. The pickoff tap 714 is then delivered from each attenuator device 712 into a summing circuit 716. The summing circuit 716 preferably uses a plurality of resistors 718 which interconnect to a common node 720. The signal appearing at this node is weighed depending upon the influence predeterminedly given to each of the environmental factors 76. The output at node 720 is further delivered into an operational amplifier 722 whose output is fed back into the input through the resistor 724. The output of the operational amplifier 722 is delivered into a detector circuit 724 and into a diode 726 that is grounded through a capacitor 728 and founded in parallel through a potentiometer 730 having a pickoff tap 732. Pickoff tap 732 is interconnected with lead 25*b* for delivery into the delivery modifier 22 and into resistor 560 as previously discussed. In operation, the potentiometers are set to give weight to the environmental factor. For example, if an air conditioner turns off, it may be desirable to simulate the sound of the air conditioner by injecting greater noise into the room 30. Conversely, if it is desired to mask the noise of the air conditioner while ON sufficient mask noise can be generated to mask this sound. In both cases, the signal from detector 708 is used to change the gain of amplifier 544. Numerous other combinations and environmental considerations wherein spectrally shaping and amplitude adjusting of masking noise can be effectively used to enhance the psychological perception of the world by a person in room 30 by using the output at 25*b* to adjust the shape at potentiometer 516 or the amplitude at potentiometer 538 with conventional approaches.

Figure 8:
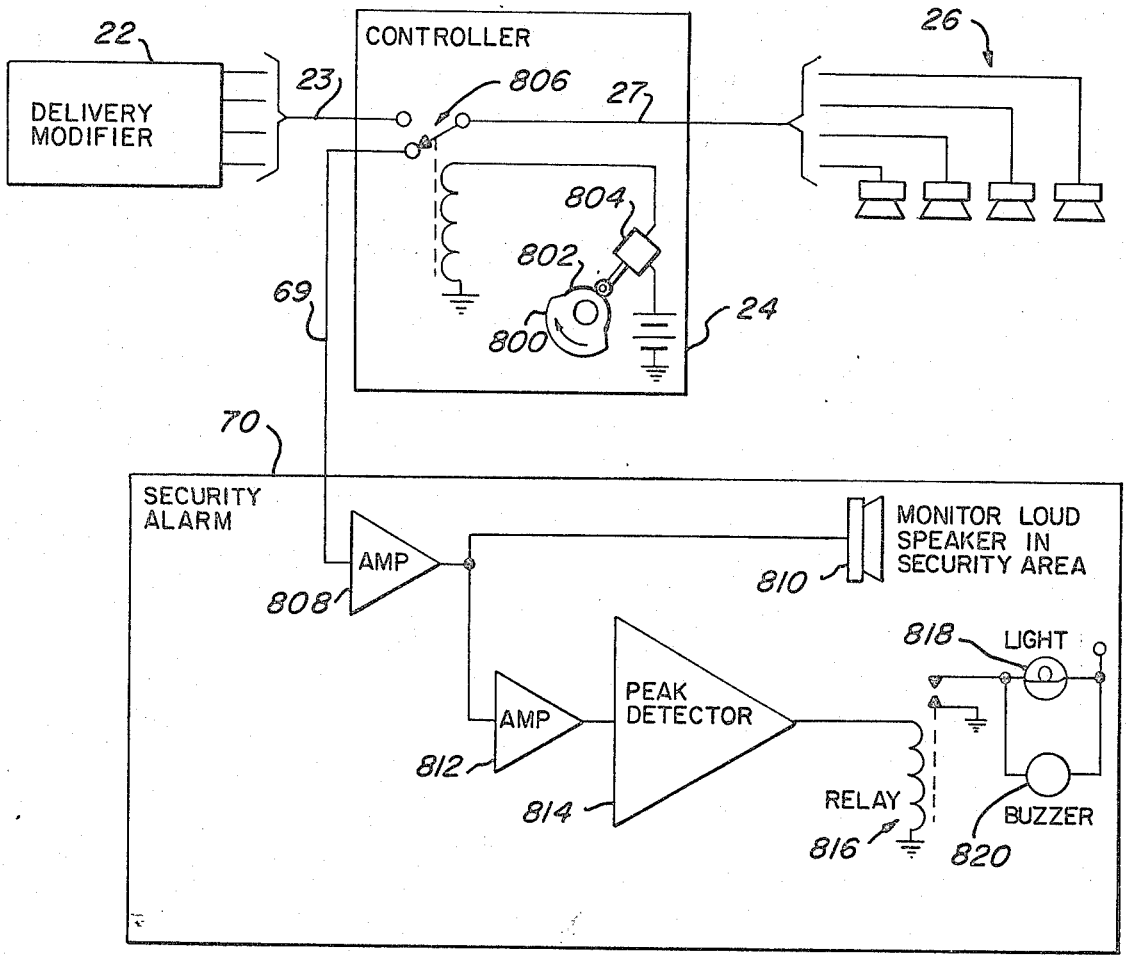
FIG. 8 is an electronic schematic for the security alarm and controller of the present invention.

The security alarm circuit 70 is shown in FIG. 8 to be interconnected with the output 23 from the delivery modifier 22, the input 27 to the loudspeakers 26 and to be interactive with the controller 24 over lead 69. In the controller 24 is provided a time driven cam 800 which has a depressed region 802 during which a microswitch 804 becomes activated to effectuate a relay 806 to switch the inputs 27 to speakers 26 to leads 69 for delivery of the speaker signals into the security alarm circuit 70. It is to be noted that at this time, all audio outputs from the delivery modifier appearing on leads 23 become disconnected from the loudspeakers. In the security alarm mode, the sound conditioning system 10 of the present invention utilizes the loudspeakers 26 as microphones to pick up any sound above an ambient level in room 30. These sound pickups are delivered over lead 69 into an operational amplifier 808 whose output drives a monitor loudspeaker 810 located in an area remote from room 30. In addition, the output from amplifier 808 is further amplified by amplifier 812 for delivery into a peak detector 814. When the invasion noise in room 30 exceeds a predetermined peak, the output activates a relay 816 which in turn activates in a conventional fashion a light 818 and a buzzer 820. The security alarm system can comprise any number of conventional circuitries that utilize as inputs a sound detecting level.

Figure 9:
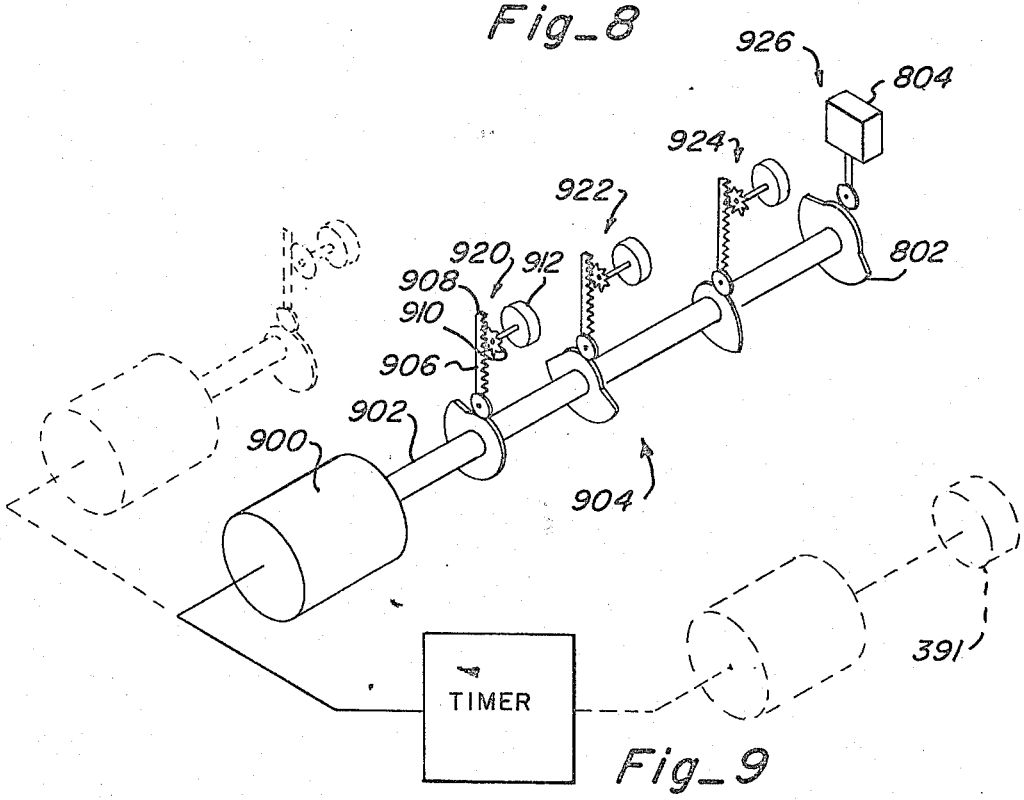
FIG. 9 is a diagrammatic representation of the mechanical cam controller of the present invention.

In FIG. 9 is the preferred embodiment of the mechanical control for the controller 24 of the sound control system 10 of the present invention. While the following is a detailed discussion of a preferred arrangement involving cams and mechanical interconnecting links, other conventional approaches may be utilized including an all solid state approach based on microprocessor design. The cam and mechanical link approach has been preferably used due primarily to low cost and high reliability over long range use and application. However, the use of such cams and interconnecting mechanical links is not meant to limit or delimit the scope of this invention since one skilled in the art could adopt the spirit and scope of this invention to an all solid state approach.

A motor 900 is provided to drive an interconnecting shaft 902 to which is interconnected a plurality of cams 904. Each cam is specifically shaped in a predetermined pattern to drive a mechanical link 906 having disposed on one end a rack 908 driving a pinion gear 910 which is connected to a standard resistive potentiometer 912. In FIG. 9, the first set of cam timing control devices 920 controls the spectral distribution of the random noise and drives potentiometer 516 of FIG. 5. The second set 922 of cam timing devices controls the amplitude of the combined music and shaped noise by specifically controlling the resistance in potentiometer 540 of FIG. 5. A third set 924 controls the amplitude of the injected music into the sound system 10 by interacting with potentiometer 528 of FIG. 5. The control cam for the security alarm circuit comprises the fourth set 926 and interacts with the microswitch 804 in FIG. 8. It is to be understood that within the spirit and scope of this invention, any potentiometer previously described can be similarly controlled by the addition of a new cam and mechanical interlink connection. For example, shown in dotted lines in FIG. 9 is an alternative embodiment wherein a separate motor based upon a predetermined timing sequence is shown to automatically switch the input of noise from white to pink to red or in any other combination by means of a mechanical interlink 391 as shown in FIG. 3. In addition, motor 950 may be used to selectively operate the potentiometers 712 of the environmental controller 24 of FIG. 7 with cam assemblies 952. It is to be understood that a motor 900 is provided for each delivery modifier 22 in order to spatially control the sound in each speaker.

Figure 10:
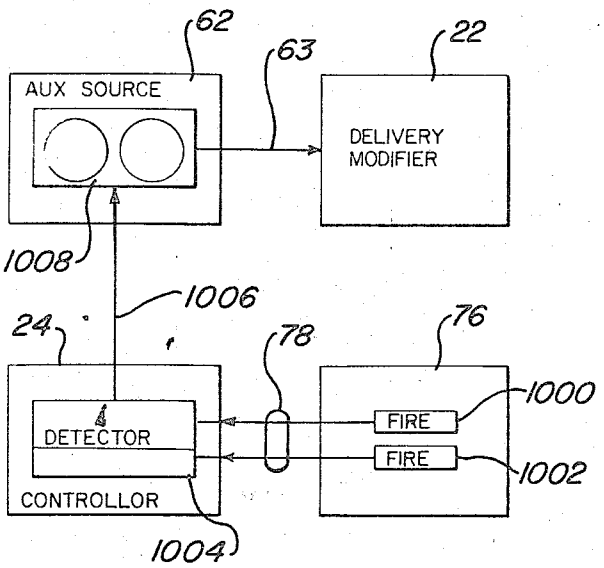
FIG. 10 is a diagrammatic representation of the fire detector circuit of the present invention.

In FIG. 10 is disclosed the fire control mode of operation of the sound control system 10 of the present invention. Two fire detectors are provided in the environmental detector package 76. The first fire detector 1000 is used to detect fire in room 30 and may comprise any of a number of conventional fire detectors including those for detecting smoke, heat and light. A similar detector 1002 is found in room 38. Assume that floors 30 and 38 are two consecutive floors in a highrise office or apartment buildings. These signals are delivered over cable 78 into the controller 24 and into a detector 1004 located within the controller 24. This detector 1004 is also conventional and may comprise any number of a plurality of conventional fire detectors. The output of the detector is a signal delivered over lead 1006 into the auxiliary source 62. The signal on lead 1006 from the detector 1004 activates a prerecorded tape deck or the like 1008. A prerecorded message is then played over lead 63 which is delivered into the delivery modifier 22 over lead **25*a* of FIG. 5. This prerecorded message corresponds to the paging signal in the above discussion. In operation, if fire is detected in room 30 by detector 1000, a prerecorded message giving instructions as to what to do is paged into room 30 via speakers 26. In the event that fire is detected in the floor below, a prerecorded message delivered into room 30 may, for example, give instructions to go to higher floors rather than to flee to floors below. It can be readily understood, that the present invention may have a plurality of speakers 26** residing on each floor of the highrise building or apartment house and that under the teachings of this invention, a well thought out plan of fire protection for the inhabitants of the building through use of prerecorded messages can be effectively used to save lives by giving proper directions in which to flee.

In operation, the sound control system 10 as shown in FIG. 1 primarily provides the means responsive to a plurality of inputs for shaping the spectrum and the amplitude of masking noise, as well as combining music or other auxiliary sound sources into a room 30. The inputs may comprise a variety of inputs such as the various environmental factors of humidity, heat, light, ionization and sound. It may further respond to various emergency signals such as those emanating from fire detectors for delivering a certain sequence of sound including prerecorded messages into room 30. Primarily, however, the disclosed invention teaches the use of a system changing with the elapse of time. What is disclosed, therefore, is a dynamic and adaptive sound control system which responds to input factors in a preprogrammed periodic sequence of timed events. The system is designed to eliminate duplicate efforts, to combine into one package a single system that totally controls the sound environment within a room based on that room's noise, environment and emergency characteristics.

Therefore, in order to practice the method of the present invention, it is first necessary to analyze the noise characteristics of the room through use of a sound level meter and analyzer such as that manufactured by General Radio as Model No. 1933. In this manner, noise characteristics of the room 30, for example, can be plotted as shown, for example, in FIG. 2 for time intervals A through D. Once the noise characteristics of the room are determined as shown in ambient noise curves 34 and intrusion noise curves 40, the shape of the masking noise to insure privacy can be tailored to the specific characteristics of the ambient and intrusion noise. This tailoring of the masking noise is crucial since it is desired at all times to minimize the level of all noise within the room. In time interval A, the noise masking curve 42 is substantially different from the noise masking curves in B and C; and B, in truth, is different from the curve in C. This continually changing spectral and amplitude distribution of the masking noise is important in order to optimally design a sound masking system for room 30.

In the method of the present invention, the ambient noise is determined and plotted in graphs similar to those shown in FIG. 2. Based on the ambient noise characteristics of that specific room, the intrusion noise is further determined and plotted on the same graphs to determine the unique characteristics of the intrusion noise within the room. Then, an optimal configuration for masking noise is determined to effectively counter both the ambient and the intrusion noise. It is to be noted, that while only four intervals are shown in FIG. 2, numerous intervals can be selectively picked, measured and charted as shown in FIG. 2 throughout the twenty-four hour period of a typical day. Indeed, the present invention may be adapted to incorporate weekly or even seasonable changes in the noise environment of room 30.

The controller 24 is now preprogrammed to repeatedly generate the desired shaping of the spectrum in adjusting of the amplitude of the noise pattern within room 30. In the preferred embodiment, this is done by shaping the cams 904 in FIG. 9 to an appropriate shape to effectively adjust a respective potentiometer 914 in the previously described circuits. It is to be understood that the shaping of the cam is totally dependent upon the specific characteristics of room 30 and varies dependent upon the noise characteristics in that room. It is to be further understood, that one skilled in the art could preprogram a digital controller to perform the same function.

Likewise, background music may be injected into the room 30 based on that room's acoustical and desired levels of music. For example, the amplitude of the music may be varied during the day, as mentioned, from a high amplitude in the morning to a low amplitude in the afternoon. The amplitude of the music must be matched to the acoustical conditions of the room 30 and once those conditions are determined, the appropriate cam 904 in FIG. 9 is shaped to correspond to that desired amplitude of music.

Further considerations include the security circuit, the paging signals, the fire detector arrangements and so forth. Under the method of the present invention, a variety of parameters for the room are initially ascertained, the controller is preprogrammed to respond to these specific parameters in order to generate a certain sequence of sound within room 30 whether that sound be background masking noise, music, paging signals, emergency messages, or the like. For example, during the late evening hours, the ambient noise is measured by the sound meter and analyzed and charted as shown in time interval D of FIG. 2. It is desired then to detect any invasion noise above the ambient level. A detector is provided in FIG. 8 which is designed to ignore the ambient noise and to detect any level above that as invasion noise and to signal an alarm. Once again, the security arrangement has been tailored to the specific room 30 including its construction or acoustical environment.

Although the present invention has been described, therefore, with a certain degree of preference and particularity, it is to be expressly understood that the present disclosure has been made by way of example and that changes in details of structure may be made without departing from the spirit thereof.

We claim:

1. A sound control system for operation in a room of a building, said system comprising:
   - means for producing masking noise,
   - means for providing a plurality of cyclic predetermined timed intervals, each of said intervals being capable of being a different time duration,
   - means receptive of said noise and cooperative with said providing means for automatically modifying said noise in a plurality of predetermined patterns corresponding to said plurality of intervals, and
   - speakers receptive of said modified noise for injecting said modified noise into said room.

2. The sound control system of claim 1 in which said producing means comprises means for generating white random noise.

3. The sound control system of claim 1 in which said producing means comprises means for generating pink random noise.

4. The sound control system of claim 1 in which said producing means comprises means for generating red random noise.

5. The sound control system of claim 1 in which said producing means comprises means for selectively outputting said white noise, said pink noise and said red noise.

6. The sound control system of claim 5 in which said outputting means cooperates with said providing means to automatically make said selection at cyclic predetermined time intervals.

7. The sound control system of claim 1 in which said modifying means further includes means operative with said providing means for slowly changing the noise modification from state-to-state so that the change in the noise make-up is imperceptible.

8. The sound control system of claim 1 in which said modifying means comprises means cooperative with said providing means for changing the amplitude of the noise in a predetermined cyclic pattern.

9. The sound control system of claim 1 in which said modifying means comprises means cooperative with said providing means for changing the spectrum of the noise in a predetermined cyclic pattern.

10. The sound control system of claim 1 in which said modifying means comprises means cooperative with said providing means for changing the spatial distribution of said sound in said speakers of the noise in a predetermined cyclic pattern.

11. The sound control system of claim 1 further comprising means for producing music, and means in said modifying means for mixing said music with said modified noise.

12. The sound control system of claim 11 in which said mixing means cooperates with said providing means to mix said music with said modified noise in a predetermined pattern.

13. The sound control system of claim 12 in which said mixing means cooperates with said providing means to mix said music with said noise in a predetermined amplitude pattern.

14. The sound control system of claim 1 further comprising:
   - means in said providing means for generating first and second timed intervals,
   - said speakers being selectively capable of transmitting said noise and detecting sound within the room,
   - means operative in said first timed interval for extending said masking noise to said speakers, and
   - means operative in said second timed interval for signaling the presence of any sound pick-up in said speakers.

15. The sound control system of claim 14 in which said signaling means comprises:
   - means operative in said second timed interval for detecting any sound pick-up in said speakers,
   - an alarm, and
   - means responsive to said detection of sound for activating said alarm.

16. The sound control system of claim 1 further comprising a plurality of environmental detectors in said room, each of said detectors being responsive to an environmental factor for generating a unique output representative of said factor, said modifying means being responsive to said outputs from said detectors for modifying said noise in a predetermined pattern.

17. The sound control system of claim 16 in which said plurality of detectors includes means for detecting the temperature of said room.

18. The sound control system of claim 16 in which said plurality of detectors includes means for detecting the humidity of said room.

19. The sound control system of claim 16 in which said plurality of detectors includes means for detecting the light level of said room.

20. The sound control system of claim 16 in which said plurality of detectors includes means for detecting the ionization level of said room.

21. The adaptive noise making system of claim 16 in which said plurality of detectors includes means for detecting the noise level of said room.

22. The sound control system of claim 16 further comprising:

means for producing music, and means in said modifying means for mixing said music with said modified noise.

23. The sound control system of claim 16 further comprising:

means in said providing means for generating first and second timed intervals, said speakers being selectively capable of transmitting said noise and detecting sound within the room, means operative in said first timed interval for extending said masking noise to said speakers, and means operative in said second timed interval for signaling the presence of any sound pick-up in said speakers.

24. The sound control system of claim 1 further comprising:

means for extending paging signals into said room, and means in said modifying means for mixing said paging signals with said modified noise.

25. The sound control system of claim 24 further comprising:

means in said building for detecting fire, and means responsive to the detection of fire for extending prerecorded emergency messages into said paging means.

26. A dynamic noise masking system for operation in a room, said system comprising:

means for producing random masking noise, means for providing a plurality of cyclic predetermined timed intervals, first means operative with said providing means for changing the spectral shape of said noise in a predetermined cyclic fashion, second means operative with said providing means for changing the amplitude of said noise in a predetermined cyclic fashion, and a plurality of speakers receptive of said noise modified by said first and second means for injecting said modified noise into said room.

27. The dynamic noise masking system of claim 26 further comprising third means operative with said providing means for changing the distribution to said loudspeakers in a predetermined cyclic spatial pattern.

28. The dynamic noise masking system of claim 26 further comprising:

means for producing music, and means for mixing said music with said noise before delivery of said noise to said speakers.

29. The dynamic noise masking system of claim 26 further comprising:

means in said providing means for generating first and second timed intervals, said speakers being selectively capable of transmitting said noise and detecting sound within the room, means operative in said first timed interval for extending said masking noise to said speakers, and means operative in said second timed interval for signaling the presence of any sound pick-up in said speakers.

30. The dynamic noise masking system of claim 26 further comprising a plurality of environmental detectors in said room, each of said detectors being responsive to an environmental factor for generating a unique output representative of said factor, said first and second changing means being responsive to said outputs from said detectors for modifying said noise in a predetermined pattern.

31. The dynamic noise masking system of claim 26 further comprising:

means for extending paging signals into said room, and means in said system for mixing said paging signals with said noise before delivery of said noise to said speakers.

32. The dynamic noise masking system of claim 31 further comprising:

means in said building for detecting fire, and means responsive to the detection of fire for extending prerecorded emergency messages into said paging means.

33. A sound control system for operation in a room of a building having a set of loudspeakers mounted thereon:

first means operative with said speakers for extending masking noise into said room, second means operative with said speakers for extending music above the level of said masking noise into said room, third means operative with said speakers for extending paging signals above the level of said music, means in said third means responsive to the presence of fire in said building for extending emergency commands to said speakers, and fourth means operative with said speakers for selectively listening to the sound in said room for signaling the presence of an intruder in said room, said speakers being capable of microphonic pick-up when said fourth means is selectively activated.

34. A method for dynamically controlling masking noise in a room, said method comprising the steps of:

determining the spectrum and amplitude of ambient noise in the room at different intervals during a day of twenty-four hours, determining the spectrum and amplitude of instrusion noise at different intervals during the day, generating random masking noise, and continually modifying the amplitude and spectrum of the masking noise to mask over the determined ambient and intrusion noise at the different intervals, said step of modifying being cyclic day-by-day.

* * * * *

UNITED STATES PATENT AND TRADEMARK OFFICE

CERTIFICATE OF CORRECTION

PATENT NO. : 4,052,720

DATED : October 4, 1977

INVENTOR(S) : HOWARD NORMAN McGREGOR and ROBERT CHARLES CHANAUD

It is certified that error appears in the above-identified patent and that said Letters Patent are hereby corrected as shown below:

Column 3, Line 62, change "making" to --masking--

Column 4, Line 49, after "act as" omit "the noise, music and paging generators in order to act as".

Column 8, Line 48, change "380" to --390--.

Column 11, Line 20, change "interconnectd" to --interconnected--

Column 12, Line 15, change "554 = 2 Megom" to --554 = 1 Megom--.

Column 19, Line 10, change "making" to --masking--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*